US006028044A

United States Patent [19]

Harris

[11] Patent Number: 6,028,044

[45] Date of Patent: Feb. 22, 2000

[54] METHOD FOR CLEANING HARD AND SOFT SURFACES WITH MULTI-PURPOSE CLEANER/DEGREASER AND CARPET/ FABRIC STAIN REMOVER

[75] Inventor: Adrian James Harris, Baton Rouge, La.

[73] Assignee: Adrian J. Harris, Baton Rouge, La.

[21] Appl. No.: 09/316,576

[22] Filed: May 21, 1999

Related U.S. Application Data

[63] Continuation-in-part of application No. 08/946,866, Oct. 8, 1997, abandoned.

[51] Int. Cl.[7] ..... C11D 1/831

[52] U.S. Cl. ..... 510/280; 510/278

[58] Field of Search ..... 8/137; 510/278, 510/280; 134/42

[56] References Cited

U.S. PATENT DOCUMENTS 4,861,501 8/1989 Pfeifer ..... 252/8.6
5,061,763 10/1991 Moss, III et al. ..... 525/502
5,789,361 8/1998 Talley ..... 510/218
5,858,281 1/1999 Dellinger, Jr. et al. ..... 252/353

FOREIGN PATENT DOCUMENTS

WO 96/11249 4/1996 WIPO .

*Primary Examiner*—Yogendra Gupta
*Assistant Examiner*—John R. Hardee

[57] ABSTRACT

Multi-purpose cleaner utilizes emulsifyng surfactants and wetting agents to provide all purpose cleaning and degreasing of hard and soft surfaces. The unique combination of chemical components produces rapid emulsification and allows easy removal of a wide variety of carpet and fabric stains also. Formula consists essentially of the following constituents:

(e) 0.8–5% by weight dialkyl sodium sulfosuccinate surfactants, (f) 3.1–15% by weight emulsifying surfactants, preferably NPE 9–12, (g) 1.9–10% by weight isopropanol, and (h) 70–94.2% by weight water.

1 Claim, No Drawings

METHOD FOR CLEANING HARD AND SOFT SURFACES WITH MULTI-PURPOSE CLEANER/DEGREASER AND CARPET/ FABRIC STAIN REMOVER

Continuation-in-part of Ser. No. 08/946,860, Oct. 8,1997, now abandoned.

BRIEF SUMMARY

The following specification details the application, composition, uses, properties, reactivity data, mixing and first aid measures associated with the specified multi-purpose cleaner/degreaser with carpet and fabric stain remover. Once applied properly, this non-toxic, biodegradable solution is specially formulated to rapidly remove grease and dirt stains from a variety of hard and soft surfaces; fabrics and carpet included. It is also formulated for rapid drying after use and leaves no sticky residue.

DETAILED DESCRIPTION

The chemical solution for the multi-purpose cleaner with carpet and fabric stain remover utilizes the following types of components: dialkyl sodium sulfosuccinate surfactants (anionic), nonionic emulsifying surfactants—preferably nonylphenol ethoxylate 9–12, isopropanol and water.

Uses and Application

This cleaner can be used to degrease, clean and/or remove spots and stains from the following: walls, vinyl surfaces, floors, tiles, tubs, ceilings, furniture, vents, equipment surfaces, carpets, various fabrics and other surfaces. Solution emulsifies stains caused by spills from food, soda, coffee, wine, kool-aid, oil, etc.

For general cleaning, spray directly on heavy-duty dirt. Do not dilute. For light-duty cleaning, add 2–4 ounces to 1 quart water. For carpet cleaning, vacuum loose dirt prior to use. Spray entire stain completely. However, do not saturate. Blot gently with a clean, damp, color-fast sponge or cloth. For fabric cleaning, completely cover stain and rub in to penetrate. Launder with regular detergent in warmest water fabric will accept. Re-apply and wash again for tough stains.

For best results, treat stain while fresh and allow cleaner to set 3–5 minutes. Properties:

| | |
|---|---|
| Volatile volume %: | <1 |
| Water solubility: | Dispersible |
| Appearance: | Clear liquid |
| Ph: | Near neutral |
| Toxicity | Non |
| Reactivity Data: | |
| Stability: | Stable |
| Hazardous polymerization: | Will not occur |
| Biodegradable | |

Additional unique properties: acceptable foaming properties and fast drying.

Wetting agents are preferably a solution of dialkyl sodium sulfosuccinate of the formula:

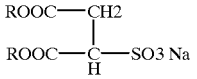

Wherein R═C8–C18

Preferably the solution should be mixed with the following proportions of ingredients: 0.8–5% by weight dialkyl sodium sulfosuccinate surfactants; 3.1–15% by weight emulsifying surfactants, preferably nonylphenol ethoxylate 9–12 (NPE 9–12); 1.9–10% by weight isopropanol; 70–94.2% by weight water.

Solution can be obtained by mixing solvents first. Mix until homogeneous. Add water slowly with stirring.

I claim:

1. A method of cleaning a rug or a carpet, wherein a rug or carpet in need of cleaning is contacted with a cleaningly effective amount of a composition consisting of a) 0.8–5% by weight of dialkyl sodium sulfosuccinate, wherein the alkyl groups are of 8–18 carbons;

b) 3.1–15% by weight of an ethoxylated nonylphenol bearing 9–12 equivalents of ethylene oxide;

c) 1.9–10% by weight of isopropanol;

d) 70–94.2% by weight of water.

* * * * *